US005474887A

United States Patent [19]

Reed et al.

[11] Patent Number: 5,474,887

[45] Date of Patent: Dec. 12, 1995

[54] PHOTOGRAPHIC ELEMENTS CONTAINING PARTICULAR BLUE SENSITIZED TABULAR GRAIN EMULSION

[75] Inventors: Kenneth J. Reed, Rochester; Sang H. Kim, Pittsford; Thomas R. Dobles, Hilton; David A. Stegman, Churchville, all of N.Y.

[73] Assignee: Eastman Kodak Company, Rochester, N.Y.

[21] Appl. No.: 227,931

[22] Filed: Apr. 15, 1994

[51] Int. Cl.[6] ..... G03C 1/035; G03C 1/16

[52] U.S. Cl. ..... 430/567; 430/574; 430/583

[58] Field of Search ..... 430/567, 574, 430/583

[56] References Cited

U.S. PATENT DOCUMENTS

| | | | |
|---|---|---|---|
| 3,847,613 | 11/1974 | Sakazume et al. | 96/74 |
| 3,881,936 | 5/1975 | Hayakawa et al. | 96/216 |
| 3,976,492 | 8/1976 | Hinata et al. | 96/100 |
| 3,982,950 | 9/1976 | Shiba et al. | 96/139 |
| 4,018,610 | 4/1977 | Hinata et al. | 96/124 |
| 4,040,841 | 8/1977 | Hinata et al. | 96/126 |
| 4,232,118 | 11/1980 | Okauchi et al. | 430/574 |
| 4,439,520 | 3/1984 | Kofron et al. | 430/434 |
| 4,518,689 | 5/1985 | Noguchi et al. | 430/574 |

FOREIGN PATENT DOCUMENTS

| | | |
|---|---|---|
| 0331414 | 9/1989 | European Pat. Off. . |
| 3925334 | 7/1989 | Germany . |
| 59-142550 | 2/1983 | Japan . |
| 58-91455 | 5/1983 | Japan . |
| 02-29642 | 7/1988 | Japan . |
| 2-029642 | 1/1990 | Japan . |
| 3-029943 | 2/1991 | Japan . |
| 3-054548 | 3/1991 | Japan . |
| 1418963 | 9/1973 | United Kingdom . |

OTHER PUBLICATIONS

Abstract of European Patent 207596 (May 1985).
Abstract of Japanese Patent 01–202746 (Feb. 1988).
Abstract of Japanese Patent 63–038931 (Aug. 1986).
Abstract of Japanese Patent 59–116645 (Dec. 1982).
Abstract of Japanese Patent 54–069429 (Nov. 1977).

*Primary Examiner*—Janet C. Baxter
*Attorney, Agent, or Firm*—Gordon M. Stewart

[57] ABSTRACT

A photographic element which has a blue sensitive emulsion with broad blue spectral coverage and yet, good speed and low fog. The element has a blue sensitive silver halide tabular grain emulsion which has a tabularity of at least 25 sensitized with a dye of formula (I) and a dye of formula (II), wherein the formula (I) dye on the emulsion has a peak sensitization of between 400–445 nm and the formula (II) dye on the emulsion has a peak sensitization of between 446–500 nm:

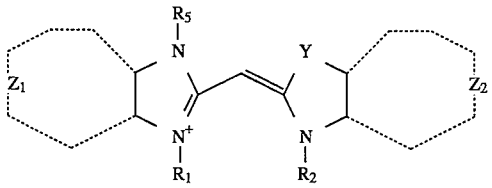

(I)

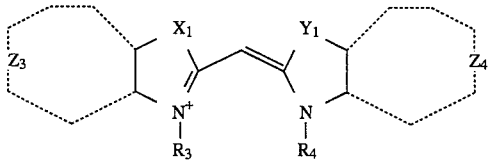

(II)

wherein:

$Z_1$, $Z_2$, $Z_3$ and $Z_4$ independently represent the atoms necessary to complete a substituted or unsubstituted benzene or naphthylene;

X, Y, $X_1$ and $Y_1$ are independently O, S, Se or $MR_5$, provided that at least X or Y is O or $NR_5$, where $R_5$ is a substituted or unsubstituted alkyl or aryl;

$R_1$, $R_2$, $R_3$ and $R_4$ independently represent H or a substituted or unsubstituted alkyl or aryl.

16 Claims, No Drawings

PHOTOGRAPHIC ELEMENTS CONTAINING PARTICULAR BLUE SENSITIZED TABULAR GRAIN EMULSION

FIELD OF THE INVENTION

This invention relates to photographic elements containing high tabularity tabular silver halide grains which are blue sensitized with a particular monomethine cyanine dye combination.

BACKGROUND OF THE INVENTION

Silver halide photography usually involves the exposure of silver halide photographic element with light in order to form a latent image that is developed during photographic processing to form a visible image. Conventional silver halide grains, such as cubic or polymorphic silver halide, typically has some intrinsic sensitivity to light in the blue region of the spectrum. In order to sensitize the silver halide to other than the blue region, sensitizing dyes are used in the silver halide emulsion. Sensitizing dyes are chromophoric compounds (for example, cyanine dye compounds). Their usual function is to adsorb to the silver halide and to absorb light (usually other than blue light) and transfer that energy via an electron to the silver halide grain thus, rendering the silver halide sensitive to radiation of a wavelength other than the blue intrinsic sensitivity. However, sensitizing dyes can also be used to augment the sensitivity of silver halide in the blue region of the spectrum.

The use of low bulk iodide (<6%), high tabularity (>25) tabular emulsions in the blue sensitive layer of photographic films exhibits a number of advantages over conventional high iodide, three dimensional emulsion grains (such as cubic, octahedral, tetrahedral and polymorphic grains). Among these advantages are: better green and red layer optical sharpness (due to the more specular light scattering properties of tabular grains), the potential for larger green-onto and red-onto blue interimage for color correction, and less developer seasoning and better fixing properties (due to the lower bulk iodide content). A disadvantage is the inherently lower intrinsic blue light sensitivity of the tabular emulsion, which manifests itself in an inability to faithfully reproduce certain blue colors, most notably that of saturated deep blue sky.

One solution to the lack of intrinsic blue light sensitivity is to dye the emulsion with a combination of blue spectral sensitizing dyes covering the wavelength region 400 to 500 nm. For convenience these combinations are usually limited to a short wavelength dye (400 to 445 nm) and a longer dye (greater than 445 nm). A number of references have previously described the use of blue sensitizing combinations. For example, U.S. Pat. Nos. 4,439,520 and 4,425,425 describe supersensitizing dye combinations on tabular grains or combinations which can provide an absorption peak intermediate between the dyes.

Blue spectral dye combinations on morphologies other than tabular grains have also been taught. For example, U.S. Pat. No. 4,518,689 describes the use of at least one monomethine cyanine dye on inner latent image type octahedral silver halide emulsions to provide an increase in spectral sensitivity and maximum density. EP 0 314 104 describes the use of dyes on cubic emulsions for lithographic applications. Binary dye combinations (400 to <445 nm and 445 to 490 nm) on silver chloride emulsions are also described in U.S. Pat. No. 4,469,785 to impart good color reproducibility.

However, the use of two blue sensitizing dyes can result in loss of speed compared to the use of one dye alone. Additionally, some dye combinations may result in more fog (that is, a minimum density appearing in the developed element even in areas of no light exposure).

It would be desirable then to provide a photographic element which contains a high tabularity tabular grain emulsion in the blue sensitive emulsion, which is sensitized by at least two spectral sensitizing dyes so as to have good sensitivity in the blue region of the spectrum and still retains good speed while exhibiting low fog.

SUMMARY OF THE INVENTION

The present invention realizes that loss of photographic speed on high aspect tabular grain emulsions is often caused by the use of a two dye combination (short, ≦445 nm plus long, ≧446 nm) when compared to the use of only a single long wavelength absorbing dye. This problem is inherent in the photophysics of blue light absorption via spectral sensitizing dyes. Due to a finite emulsion surface area, the addition of a second short wavelength absorbing dye requires a reduction in the amount of long wavelength dye. Since typical light sources, for example daylight and tungsten lamps, exhibit a fall-off in light intensity as one progresses from longer to shorter wavelengths, the emulsion sensitized with the dye combination will absorb less light than when it is dyed with the single long wavelength dye. The reduced light absorption translates into a resultant speed loss for the dye combination. A second factor, the tendency of the oscillator strength (intensity of light absorption) to diminish for shorter wavelength absorbing dyes further exacerbates the speed loss problem.

The present invention realized that to avoid this problem and still obtain a film with low fog and good blue spectral sensitivity over most of the blue spectral region, the selection of the correct blue sensitizing dyes for high tabularity tabular grain emulsions is crucial.

Accordingly, the present invention provides a photographic element comprising a blue sensitive silver halide tabular grain emulsion which has a tabularity (as defined later in this application) of at least 25. The emulsion is sensitized with a dye of formula (I) and a dye of formula (II), wherein the formula (I) dye on the emulsion has a peak sensitization of between 400–445 nm and the formula (II) dye on the emulsion has a peak sensitization of between 446–500 nm:

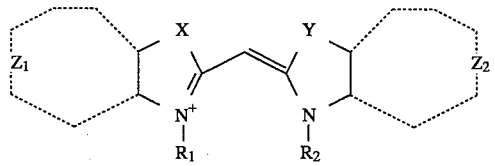

(I)

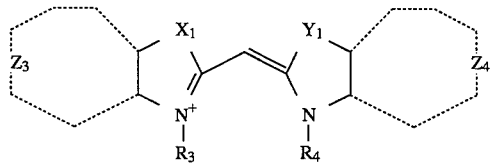

(II)

wherein:

$Z_1$, $Z_2$, $Z_3$ and $Z_4$ independently represent the atoms necessary to complete a substituted or unsubstituted benzene or naphthylene;

X, Y, $X_1$ and $Y_1$ are independently O, S, Se or $NR_5$, provided that at least X or Y is O or $NR_5$, wherein $R_5$ is an alkyl, alkenyl or aryl (preferably alkyl or aryl), any of which may be substituted or unsubstituted;

$R_1$, $R_2$, $R_3$ and $R_4$ independently represent an alkyl, alkenyl or aryl (preferably alkyl or aryl), any of which may be substituted or unsubstituted.

EMBODIMENTS OF THE INVENTION

In the above and throughout this application, it will be understood that reference to a substituted or unsubstituted benzene ring does not include a benzene ring with other annellated aromatic rings. Thus, a substituted or unsubstituted benzene ring does not include naphthylene or higher fused ring systems. Similarly, reference to substituted or unsubstituted naphthylene does not include anthracene or higher fused ring systems.

In the formula (I) and (II), $R_1$, $R_2$, $R_3$ and $R_4$ may particularly be a substituted or unsubstituted lower alkyl (that is, from 1 to 6 carbon atoms), or may preferably be a substituted or unsubstituted 1 to 4 carbon atom alkyl. The dye of formula (I) may particularly be selected to provide a peak sensitivity, on the emulsion, of between 436 to 444 nm (or even 430– 440 nm or 433–437 nm).

The dye of formula (I) may be a dye of formula (Ia) or (Ib), while the dye of formula (II) may, for example, be a dye of formula (IIa):

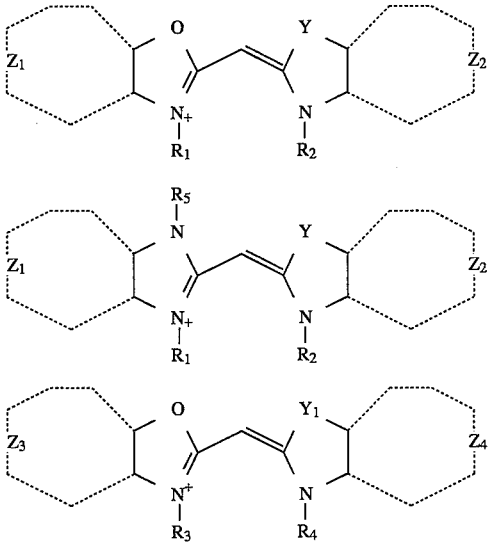

Preferably, at least one of $Z_1$ or $Z_2$ form a benzene ring. Dyes of formulae I and II may particularly have at least one acid or acid salt group, such as a carboxy, sulfonamido, sulfamoyl, sulfato or sulfo substituent. This may particularly be on $R_3$ and/or $R_4$, and even more particularly $R_3$ and/or $R_4$ may be an alkyl group substituted with such an acid or acid salt group ($R_3$ and/or $R_4$ may particularly be a sulfoalkyl group, such as sulfomethyl, sulfoethyl, sulfopropyl, of sulfobutyl).

Any of the alkyl groups described above include cycloalkyl. Examples of any of the alkyl groups mentioned above are methyl, ethyl, propyl, isopropyl, butyl, isobutyl, t-butyl, pentyl, hexyl, octyl, 2-ethylhexyl, and the like. Particular cycloalkyl groups can be cyclopentyl, cyclohexyl, 4-methylcyclohexyl, and the like. Alkenyl groups can be vinyl, 1-propenyl, 1-butenyl, 2-butenyl, and the like. Aryl groups can be phenyl, naphthyl, styryl, and the like. Aralkyl groups (which are a type of substituted alkyl) can be benzyl, phenethyl, and the like. Useful substituents on any of the foregoing or other groups disclosed (including substituents on $Z_3$ and $Z_4$), include halogen., alkyl (particularly lower alkyl), alkoxy, acyl, alkoxycarbonyl, aminocarbonyl, carbonamido, carboxy, sulfamoyl, sulfonamido, sulfo, nitro, hydroxy, amino, cyano, trifluoromethyl and the like. Any of the foregoing (where possible) may be substituted or unsubstituted.

As to the particular tabular grain emulsion, this may be any suitable silver halide (including silver chloride, silver bromide, and the like) but in particular may be silver bromoiodide. The iodide and chloride levels therein can vary but preferably the emulsion has less than 8% iodide (or even, less than 6% or 4% iodide) while the chloride level may be less than 10% (or even less than 6% or less than 2%). It will be appreciated in the present application that when a percentage level of a specific halide is referered to, this is the mole percentage of all halides in the silver halide represented by the specific halide (for example, 2% chloride means that of all halide present, 2 mole % is chloride). The blue sensitive silver halide tabular grain emulsion is typically not sensitized with any dye which provides a maximum sensitivity on the emulsion of 500 nm or greater.

A color photographic element of the present invention may have a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer. The blue sensitive silver layer may be of the above described tabular type sensitized with a dye of formula (I) and a dye of formula (II), as already described, such that the sensitized emulsion meets the limitations as defined in U.S. patent application entitled PHOTOGRAPHIC ELEMENT CONTAINING PARTICULAR BLUE SENSITIZED TABULAR GRAIN EMULSION AND METHOD OF PROCESSING SUCH ELEMENT, filed by Kam-Ng and Michno on the same date as the present application, Attorney Docket No. 64,086. Alternatively, such blue sensitized tabular grain emulsion may be sensitized with dyes of formula I or II so as to meet the sensitivity limitations defined in U.S. patent application entitled PHOTOGRAPHIC ELEMENT CONTAINING EMULSION WITH PARTICULAR BLUE SENSITIVITY AND METHOD OF PROCESSING SUCH ELEMENT, filed by Jon Eikenberry et al. on the same date as the present application (Attorney Docket No. 68,416). The foregoing applications and any other references cited herein are incorporated in this application by reference.

For example, the blue sensitive tabular emulsion layer may be sensitized with dyes of formula (I) and (II) in accordance with the Kam-Ng application, such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\text{ nm} \leqq \lambda_{Bmax} \leqq 440\text{ nm or } 450\text{ nm} \leqq \lambda_{Bmax} \leqq 480\text{ nm}$$

and:

$$S_{485} \leqq 50\%(S_{Bmax})$$

$$S_{410} \leqq 60\%(S_{Bmax})$$

and the maximum sensitivity of the emulsion between 430–440 nm ("$S_{(430-440)max}$"), and the maximum sensitivity between 450–480 nm ("$S_{(450-480)max}$"), have the following relationship:

$$90\% \ (S_{(450-480)max}) \leq S_{(430-440)max} \leq 110\% \ (S_{(450-480)max}).$$

As to the amounts of dyes of formula (I) and (II) that would be used, the total amount of both dyes together would typically be between 0.1 to 5 millimoles of dye per mole of silver halide (mmoles/mole). Preferably, the total amount would be between 0.5 mmoles/mole to 3 mmoles/mole. As to the molar ratios of dyes (I) to (II), the ratio of (I):(II) would typically be between 1:4 to 4:1 and or even between 1:3 to 2:1.

The photographic elements of the present invention can be single color elements or multicolor elements. Multicolor elements, as already described, contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working, such as emulsions the grains of which are primarily surface-sensitive or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally a positive (or reversal) image can be formed.

The photographic elements of the present may also use colored couplers (e.g. to adjust levels of interlayer correction) and masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R.

Barr, J. R. Thirtle and P. W. Vittum in *Photographic Science and Engineering,* Vol. 13, p. 174 (1969).

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90- 072,629, 90-072,630; 90-072,632; 90-072,633; 90- 072,634; 90-077,822; 90-078,229; 90-078,230; 90- 079,336; 90-079,338; 90-079,690; 90-079,691; 90- 080,487; 90-080,489; 90-080,490; 90-080,491; 90- 080,492; 90-080,494; 90-085,928; 90-086,669; 90- 086,670; 90-087,361; 90-087,362; 90-087,363; 90- 087,364; 90-088,096; 90-088,097; 90-093,662; 90-093,663; 90-093,664; 90-093,665; 90-093,666; 90- 093,668; 90-094,055; 90-094,056; 90-101,937; 90- 103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. However, with reference to the blue sensitive record specifically, it will be understood throughout this application, that a photographic element of the present invention will contain at least one layer with a blue sensitive tabular grain emulsion of the type and sensitized in the manner described above. Preferably, all blue sensitive layers of the element will be of the foregoing type.

The grain size of the silver halide may have any distribution known to be useful in photographic compositions, and may be either polydisperse or monodisperse. Particularly useful in this invention are tabular grain silver halide emulsions.

Tabular grains are those with two parallel major faces each clearly larger than any remaining grain face and tabular grain emulsions are those in which the tabular grains account for at least 30 percent, more typically at least 50 percent, preferably 70 percent and optimally >90 percent of total grain projected area. The tabular grains can account for substantially all (>97 percent) of total grain projected area. The tabular grain emulsions can be high aspect ratio tabular grain emulsions, that is emulsions wherein ECD/t>8, where ECD is the diameter of a circle having an area equal to grain projected area and t is tabular grain thickness; intermediate aspect ratio tabular grain emulsions, that is ECD/t=5 to 8; or low aspect ratio tabular grain emulsions, that is ECD/t=2 to 5. The emulsions typically exhibit high tabularity (T), where $T=ECD/t^2$, that is $ECD/t^2 > 25$, and ECD and t are both measured in micrometers (μm). The emulsion can further have a tabularity of > 40 or even >100 or >1000. The tabular silver halide emulsions for the blue sensitive emulsion required by the present invention, though, should have a tabularity of at least 25 (such emulsions can even have a tabularity of at least 26 or 100, with tabularity ranges that can include from 25 to 4000, or from 100 to 1500).

The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum grain surface to volume ratios. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Solberg et al U.S. Pat. No. 4,433,048, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Bando U.S. Pat. No. 4,839,268, Makino et al U.S. Pat. No. 4,853,322, Nishikawa et al U.S. Pat. No. 4,952,491, Houle et al U.S. Pat. No. 5,035,992, Piggin et al U.S. Pat. Nos. 5,061,609 and 5,061,616, Nakamura et al U.S. Pat. No. 5,096,806, Bell et al U.S. Pat. No. 5,132,203, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Antoniades et al U.S. Pat. No. 5,250,403, Zola et al EPO 0 362 699, Maruyama et al EPO 0 431 585, Urabe EPO 0 460 656, Verbeek EPO 0 481 133, 0 503 700 and 0 532 801, Jagannathan et al EPO 0 515 894 and Sekiya et al EPO 0 547 912. Emulsions containing {100} major face tabular grains are illustrated by Bogg U.S. Pat. No. 4,063,951, Mignot U.S. Pat. No. 4,386,156, Maskasky U.S. Pat. Nos. 5,264,337 and 5,275,930, Brust et al EPO 0 534 395 and Saitou et al EPO 0 569 971.

The silver halide grains to be used in the invention may be prepared according to methods known in the art, such as those described in *Research Disclosure I* and James, *The Theory of the Photographic Process,* or U.S. Pat. No. 4,439,520 for precipitation of iodobromide tabular grains. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhodium, ruthenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by any sensitizing dyes and by any method known in the art, such as are described in *Research Disclosure I,* although the blue sensitive layer of the type required by the present invention will be sensitized with formuae (I) and (II) dyes as already described. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVIII. This typically involves exposure to light in the visible region of the spectrum.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. For example, a negative image can be formed by processing the element with a suitable color developer followed by removal of silver and silver halide. In the case of processing a reversal color element, the element is typically first treated with a black and white developer followed by fogging of the silver halide (chemically or by light), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The invention is described further in the following examples.

EXAMPLES

Dyes referenced in the examples below are shown in Table I. Dyes in Table I with a "C" designation are comparative dyes not meeting the structures required of long or short dyes in the present invention. If a dye is "short" then it is a formula (I) dye and the nuclei and heterocyclic ring atoms are $Z_1$ and $Z_2$, and X and Y. If a dye is "long" (indicated by "L" in the dye identification in Table I) then it is a formula (II) dye and the nuclei and heterocyclic ring atoms are $Z_3$ and $Z_4$, and $X_1$ and $Y_1$. In each case (other than C-I) $R_1$ or $R_3$, and $R_2$ or $R_4$ were 3-sulfopropyl except for dyes C-2 and C-3 (in which $R_2$ is ethyl) and dye C-4 (in which $R_4$ is methyl). "Cl benzo" represents chloro benzo. "Dye Peaks" shown in Table I below are all measured on the emulsion of Example 1. In the discussion below, "$D_{max}$" and "$D_{min}$" refer to maximum and minimum density, respectively.

TABLE I

| Dye Identification | Dye Peak and Designation | $Z_1$ or $Z_3$ | $Z_2$ or $Z_4$ | X or $X_1$ | Y or $Y_1$ |
|---|---|---|---|---|---|
| L-1 | 450.1 nm, long | B-NAPTHYL | 5-Cl BENZO | O | S |
| L-2 | 456.4 nm, long | 5-Cl BENZO | BENZO | S | S |
| C-1 | broad short | na | na | na | na |
| C-2 | 430 nm, short | B-NAPTHYL | 4-PHENYL | S | O |
| C-3 | 420 nm, short | 5-Cl BENZO | 4-PHENYL | S | O |
| I-1 | 420 nm, short | 5-PHENYL BENZO | 5-PHENYL BENZO | O | O |
| I-2 | 438 nm, short | 5-PHENYL BENZO | 5-Cl BENZO | O | S |
| C-4 | 463 nm, long | B-NAPTHYL | 4-PHENYL | S | S |
| I-3 | 440 nm, short | B-NAPTHYL | 5,6 di Cl BENZO | O | N-ETHYL |
| I-4 | 430 nm, short | 5-PHENYL BENZO | 5,6 di Cl BENZO | O | N-ETHYL |
| I-5 | 420 nm, short | 5-Cl BENZO | 5,6 di Cl BENZO | O | N-ETHYL |

"Broad short" for dye C-1 indicates that the dye provided a broad absorption band ranging from about 400 to 490 nm and centered about 445 nm.

TABLE I-continued

| Dye Identification | Dye Peak and Designation | $Z_1$ or $Z_3$ | $Z_2$ or $Z_4$ | X or $X_1$ | Y or $Y_1$ |
|---|---|---|---|---|---|

"na" means "not applicable" since dye C-1 has the following structure:

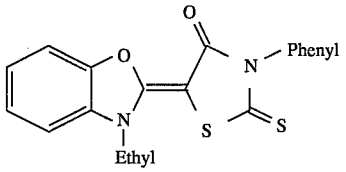

C-1?

A 2% bulk iodide tabular grain emulsion was prepared with dimensions of 1.40 micrometer equivalent circular diameter by 0.15 micrometer thick (tabularity= 62). A stable population of AgBr nuclei representing 0.5% of the final precipitation was formed at 40° C. during a one minute double jet nucleation at a pBr of 1.597. An accelerated double jet growth using 2M silver and 2.75M bromide then proceeded for an additional 60% of the precipitation at 70° C. and the same pBr. At this point the pBr can either be increased to 3.48 or else lowered to 0.9 after which 2 mole % silver iodide seeds are added to the reactor. The remainder of the precipitation is then conducted at the pBr just prior to the seed addition. The emulsion can be either iso-washed or else ultra-filtered to remove unwanted salts.

The emulsion was optimally spectrochemically sensitized with 1.2 millimoles of a given dye or dye combination, 18.1 micromoles of sodium thiosulfate pentahydrate and 5.2 micromoles of potassium tetrachloroaurate dihydrate. Other adjuvants such as pseudo halide (SCN) salt were also used. Chemical activation of the sensitizers was effected through the use of a thermal heat cycle held at for predetermined time (0 to 15 min) at 65° C. or 5 to 10 min at 75° C. The times were chosen to give nearly matched Dmax or fogs in a standard 6 minute E-6 or Rehalo process (*British Journal of Photography Annual,* 1982, pp201–203), respectively, for the different spectral sensitizing dyes used.

A mixture of sensitized emulsion and colloidal dispersion of a suitable dye-forming coupler (2-(2,4-bis(1,1-dimethylpropyl)phenoxy)-n-(4-(( 2,2,3,3,4,4,4-heptafluoro-1-oxobutyl)amino)-3-hydroxyphenyl)-hexanamide), was coated using a gelatin vehicle on a clear acetate support with anithalation protection. Appropriate surfactants as required to obtain uniform coatings were employed in addition to gelatin crosslinking agents to harden the coated film.

Dry coatings were given a stepped exposure on a Type I-b sensitometer having a 5500K color temperature with UV light excluded by a KODAK Wratten type 2B filter. Exposed coatings were then processed through a standard six minute E-6 or rehalo process. Relative reversal threshold speeds were metered using standard algorithms in which the speed is related to that point on the exposure axis that is 0.2 below Dmax if the slope of the curve were normalized to −1.0. The relative reversal image dmax or the rehalo dmin/dmax can be taken as a measure of the relative emulsion fog.

The results are summarized in Table II. The total dye level in all cases remained fixed at 1.2 millimoles/silver mole as did the molar ratio of short to long (1:2) wavelength sensitizing dye (dye (I) to (II)) when dye combinations were employed. The individually aggregated spectral sensitizing dye peaks ("Peak Abs") were detected in the binary dye combinations from absorptance measurements on unprocessed coatings. This provides a measure of peak sensitization.

TABLE II

| Short Dye (dye I) | Peak Abs provided by dye I | Long Dye (dye II) | Peak Abs provided by dye II | Dyed Speed | % Fog |
|---|---|---|---|---|---|
| — | — | L-1 | 450.1 nm | 175 | 7 |
| C-1 | BROAD | " | " | 140 | 10.1 |
| C-2 | 430 nm | " | " | 148 | 33 |
| C-3 | 420 nm | " | " | 143 | 43.3 |
| I-1 | 415 nm | " | " | 171 | 5.8 |
| I-2 | 438 nm | " | " | 183 | 7.5 |

It is evident from Table II that when 0.4 mmole of the long wavelength dye L-1 is replaced with the merocyanine dye C-1 (such as is advocated by Sugimoto et al. U.S. Pat. No. 4,609,621 or Tanaka U.S. Pat. No. 4,469,785), a speed loss of 35 is incurred. This speed loss is still quite severe, 27 and 32, if either $Z_1$ or $Z_2$ does not construct a benzo or naphtho fused ring in the short dye structure (dye C-2 and C-3 in Table II which are again the subject of Tanaka). In contrast, the dyes of the present invention (I-1 and I-2 which feature phenyl or chloro substituted benzoxazole or benzothiazole moieties) when used with the long dye L-1 show comparable fog at nearly equivalent or even better speed while obtaining greater sensitivity coverage in the blue spectral region.

In a similar set of experiments with the same long wavelength absorbing dye, L-1, the dyes of the present invention are shown (Table III) to give both a superior fog position at equal or better speed compared to the comparative dyes mentioned above. (Note that even though Tanaka et al., U.S. Pat. No. 4,469,785 claim dye C-4 to be a short wavelength absorbing dye, its peak absorption indicates that it is a long dye by the definition of the present application).

TABLE III

| Short Dye (dye I) | Peak Abs provided by dye I | Long Dye (dye II) | Peak Abs provided by dye II | Dyed Speed | % Fog |
|---|---|---|---|---|---|
| C-4 | 463 nm | L-1 | 456.5 nm | 182 | 19 |
| I-2 | 438 nm | " | " | 183 | 7.5 |
| I-3 | 440 nm | " | " | 191 | 11.5 |
| I-4 | 430 nm | " | " | 186 | 7.5 |

The speed-fog advantages provided by the dye combination of the present invention are not limited to long wavelength dyes of the benzoxazole-benzothiazole class (L-1). To show this, a further set of experiments were conducted in the same way as those for Table II above, except the short wavelength absorbing oxacyanine, I-1, and the oxathiacyanine, I-2, were each used in combination with the long wavelength benzothiazole, L-2. As shown from the results in Table IV below, the inventive dye combinations with L-2 combined with I-1 or I-2, showed both high speed and low fog versus the comparatives with dyes C-2 or C-3, while of course covering more of the blue spectrum than provided by dye L-2 alone.

TABLE IV

| Short Dye (dye I) | Peak Abs provided by dye I | Long Dye (dye II) | Peak Abs provided by dye II | Dyed Speed | % Fog |
|---|---|---|---|---|---|
| — | — | L-2 | 456.4 | 180 | 6.1 |
| C-2 | 430 nm | " | " | 169 | 25 |
| C-3 | 420 nm | " | " | 171 | 27.3 |
| I-1 | 415 nm | " | " | 172 | 3.6 |
| I-2 | 438 nm | " | " | 192 | 6.6 |

The preferred embodiment of the short wavelength dyes of this invention are the benz or naphthoimidazolooxacyanines (I-3, I-4, and I-5) as they show improved performance over the oxathiacyanines (I- 2). This is shown in the results listed in Table V below. The results of Table V were obtained in the same manner as those for the examples in Table II. DMax is the maximum densitiy, with higher DMax numbers indicating lower fog.

TABLE V

| Short Dye (dye I) | Peak Abs provided by dye I | Long Dye (dye II) | Peak Abs provided by dye II | Dyed Speed | DMax |
|---|---|---|---|---|---|
| I-2 | 438 nm | L-2 | 460 nm | 194 | 2.01 |
| I-3 | 440 nm | " | " | 204 | 2.01 |
| I-4 | 430 nm | " | " | 202 | 2.05 |
| I-5 | 420 nm | " | " | 211 | 1.81 |

Thus, the combination of a short wavelength absorbing dyes (400 nm to 445 nm) of formula I and a longer wavelength (>445 nm) absorbing dye of formula II, on the described tabular grain emulsions, provides the emulsion with broad blue spectral coverage with, at the same time, good speed and low fog. This allows such emulsions to provide good color reproduction of saturated blues such as appearing in a blue sky, with a low speed loss and low fog.

While the invention has been described in detail with particular reference to preferred embodiments, it will be understood that variations and modifications can be effected within the spirit and scope of the invention.

We claim:

1. A photographic element comprising a blue sensitive negative working silver halide tabular grain emulsion which has a tabularity of at least 25 the grains of which are primarily surface-sensitive, sensitized with a dye of formula (I) and a dye of formula (II), wherein the formula (I) dye on the emulsion provides a peak sensitization of between 400–445 nm and the formula (II) dye on the emulsion provides a peak sensitization of between 446– 500 nm:

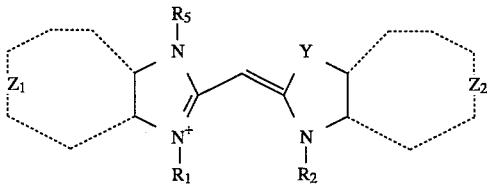

(I)

-continued

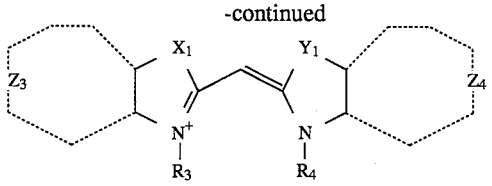

(II)

wherein:

$Z_1$, $Z_2$, $Z_3$ and $Z_4$ independently represent the atoms necessary to complete a substituted or unsubstituted benzene or naphthylene;

Y, $X_1$ and $Y_1$ are independently O, S, Se or $NR_5$;

$R_1$, $R_2$, $R_3$, $R_4$ and $R_5$ independently represent a substituted or unsubstituted alkyl or aryl.

2. A photographic element according to claim 1 wherein the dye of formula (I) is of the following formula (Ic):

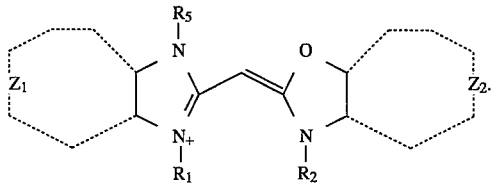

(Ic)

3. A photographic element according to claim 2 wherein $X_1$ is S and $Y_1$ is S.

4. A photographic element according to claim 1 wherein the dye of formula (II) is a dye of formula (IIa):

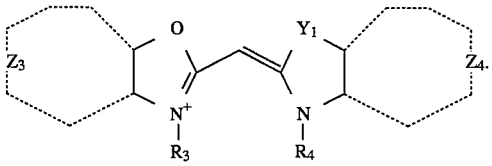

(IIa)

5. A photographic element according to claim 1 wherein the emulsion is a tabular grain emulsion of silver bromoiodide.

6. A photographic element according to claim 1 wherein at least one of $Z_1$ or $Z_2$ represents a benzene ring.

7. A photographic element according to claim 1 wherein the halide content of the blue sensitive silver halide tabular grain emulsion is less than 8% iodide.

8. A photographic element according to claim 7 wherein the halide content of the blue sensitive silver halide tabular grain emulsion is less than 2% chloride.

9. A photographic element according to claim 1 wherein the halide content of the blue sensitive silver halide tabular grain emulsion is less than 6% iodide.

10. A photographic element according to claim 1 wherein the blue sensitive silver halide tabular grain emulsion is not sensitized with any dye which provides a maximum sensitivity to the emulsion of 500 nm or greater.

11. A photographic element according to claim 1 wherein the molar ratio of dye I to dye II is from 1:4 to 4:1.

12. A photographic element according to claim 1 wherein the molar ratio of dye I to dye II is from 1:3 to 2:1.

13. A photographic element according to claim 1 wherein $X_1$ is S and $Y_1$ is S.

14. A color photographic element comprising a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer, the blue sensitive silver halide emulsion layer comprising a silver bromoiodide negative working tabular grain emulsion the halide content of which is less than 8% iodide and less than 10% chloride and the grains of which are primarily surface-sensitive, and which has a tabularity of at least 25 and is sensitized with a dye of formula (I) and a dye of formula (II) such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\text{ nm} \leqq \lambda_{Bmax} \leqq 440\text{ nm or } 450\text{ nm} \leqq \lambda_{Bmax} \leqq 480\text{ nm}$$

and:

$$S_{485} \leqq 50\%(S_{Bmax})$$

$$S_{410} \leqq 60\%(S_{Bmax})$$

and the maximum sensitivity of the emulsion between 430–440 nm ("$S_{(430-440)max}$"), and the maximum sensitivity between 450–480 nm ("$S_{(450-480)max}$"), have the following relationship:

$$90\%(S_{(450-480)max}) \leqq S_{(430-440)max} \leqq 110\%\ (S_{(450-480)max})$$

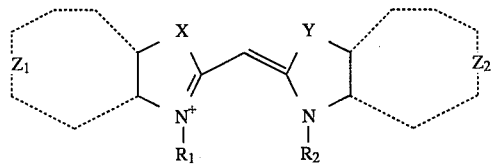

(I)

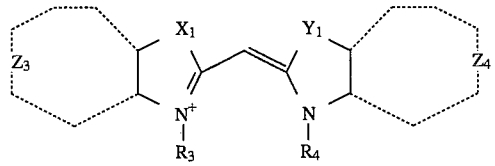

(II)

wherein:

$Z_1$, $Z_2$, $Z_3$ and $Z_4$ independently represent the atoms necessary to complete a substituted or unsubstituted benzene or naphthylene;

Y, $X_1$ and $Y_1$ are independently O, S, Se or $NR_5$, where $R_5$ is a substituted or unsubstituted alkyl or aryl;

$R_1$, $R_2$, $R_3$ and $R_4$ independently represent a substituted or unsubstituted alkyl or aryl.

15. A photographic element according to claim 14 additionally comprising a transparent support.

16. A photographic element according to claim 14 wherein $X_1$ is S and $Y_1$ is S.

* * * * *